US006328423B1

(12) United States Patent
Wong et al.

(10) Patent No.: US 6,328,423 B1
(45) Date of Patent: Dec. 11, 2001

(54) INK JET CARTRIDGE WITH INTEGRATED CIRCUITRY

(75) Inventors: Marvin G Wong, Corvallis; Gerald E. Heppell, Tigard, both of OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/374,636

(22) Filed: Aug. 16, 1999

(51) Int. Cl.[7] ..... B41J 2/14
(52) U.S. Cl. ..... 347/50; 347/49; 347/58
(58) Field of Search ..... 347/49, 50, 58, 347/59, 63, 86, 87

(56) References Cited

U.S. PATENT DOCUMENTS

| | | | | |
|---|---|---|---|---|
| 4,580,148 | | 4/1986 | Domoto et al. | 347/63 |
| 4,633,274 | * | 12/1986 | Matsuda | 347/50 |
| 4,635,073 | * | 1/1987 | Hanson | 347/50 |
| 4,727,384 | * | 2/1988 | Tsuda | 347/50 |
| 4,755,836 | | 7/1988 | Ta et al. | 347/49 |
| 4,791,440 | | 12/1988 | Eldridge et al. | 347/58 |
| 4,940,413 | | 7/1990 | Childers et al. | 439/67 |
| 4,940,998 | | 7/1990 | Asakawa | 347/37 |
| 4,949,102 | | 8/1990 | Braun | 347/44 |
| 5,040,001 | * | 8/1991 | Dunn et al. | 347/87 |
| 5,227,812 | | 7/1993 | Watanabe et al. | 347/50 |
| 5,278,584 | * | 1/1994 | Keefe et al. | 347/63 |
| 5,345,256 | | 9/1994 | Stortz | 347/20 |
| 5,515,091 | | 5/1996 | Kimura et al. | 347/86 |
| 5,548,311 | | 8/1996 | Hine | 347/50 |
| 5,565,900 | * | 10/1996 | Cowger et al. | 347/42 |
| 5,798,780 | | 8/1998 | Koizumi et al. | 347/50 |
| 5,819,406 | * | 10/1998 | Yoshizawa et al. | 29/877 |
| 6,068,367 | * | 5/2000 | Fabbri | 347/49 |

* cited by examiner

*Primary Examiner*—John Barlow
*Assistant Examiner*—Blaise Mouttet

(57) ABSTRACT

An ink jet pen with a pen body defining an ink chamber. A print head on the pen body communicates with the ink chamber. The pen body includes a number of electrically conductive traces that extend from a printer interface region to the print head. The print head may be surface mounted to the body, or connected with anisotropic or Z-axis conductive adhesive. The traces may be conductive material applied into grooves on the surface of the body, or an insert molded leadframe. The interface region and print head may be on a common surface of the body.

8 Claims, 3 Drawing Sheets

FIG. 5
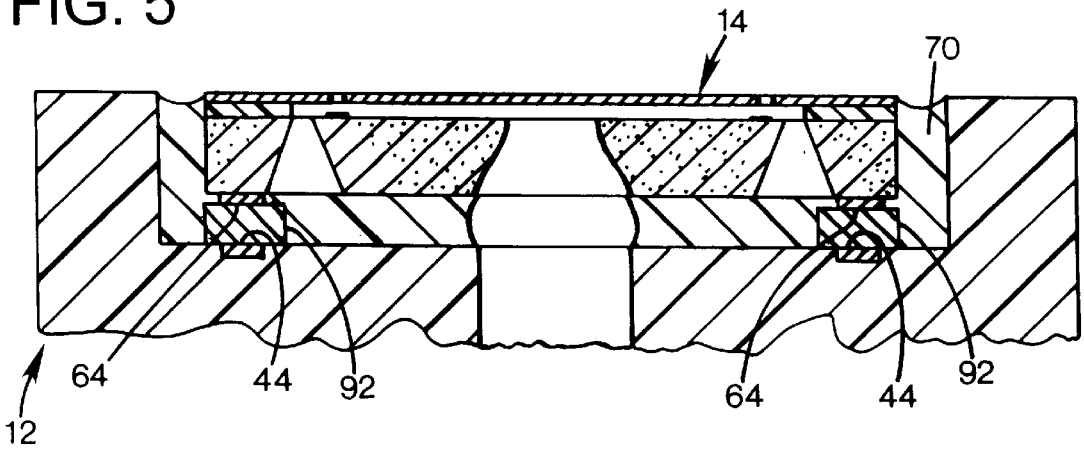
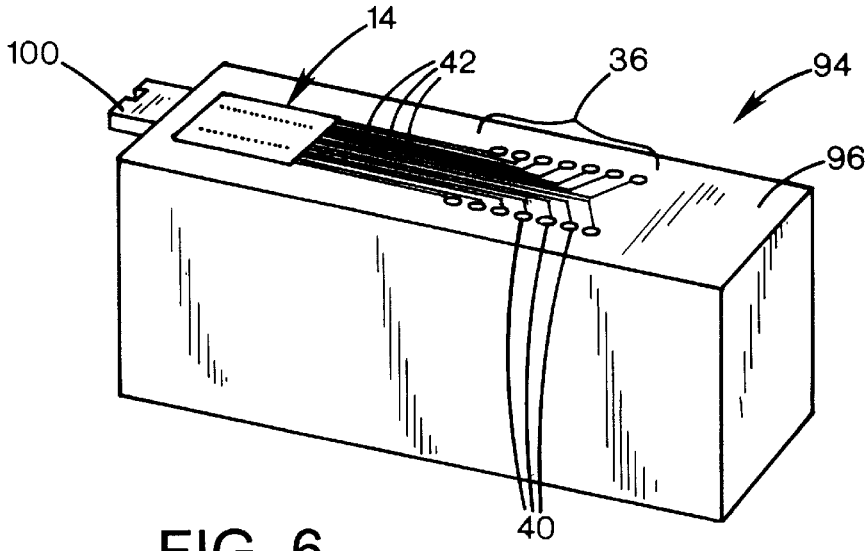
FIG. 6

INK JET CARTRIDGE WITH INTEGRATED CIRCUITRY

FIELD OF THE INVENTION

This invention relates to ink jet printers, and more particularly to ink jet printers with replaceable ink supplies.

BACKGROUND AND SUMMARY OF THE INVENTION

Ink jet printers employ pens having print heads that reciprocate over a media sheet and expel droplets onto the sheet to generate a printed image or pattern. Typically, the print head is connected to the pen at a location facing the media, and an electrical printer interface is provided at another location on the pen. The interface typically has numerous conductive lands that connect to a corresponding group of conductors located on a pen carriage, and which connect to control circuitry in the printer. A pen circuit provides connection between the lands and the print head. Typically, a flex circuit, TAB circuit, or polyimide flexible interconnect includes the lands, and connects these to pads on the semiconductor chip comprising the print head.

While effective, the primary disadvantage of this flex circuit approach is that of cost, as the circuit contributes significantly to the total cost of a pen. Because pens are often used as disposable devices that are replaced when their ink supply is depleted, the flex circuit cost contributes to the ongoing printing cost per page.

In addition, traditional flex circuit connections require additional spacing between the print head and the media. Because circuit tabs or wire bonds connect to the front surface of the print head, and are very fragile, they must be encapsulated, typically with a bead of epoxy. However, the bonds and protective encapsulant protrude beyond the face of the print head, requiring additional media clearance to avoid contact. Increasing spacing is generally disadvantageous because marginal angular drop ejection errors are magnified at greater distances, and air resistance has a greater effect over greater distances, particularly with smaller droplet sizes used for increasingly finer printing resolutions.

The present invention overcomes the limitations of the prior art by providing an ink jet pen with a pen body defining an ink chamber. A print head on the pen body communicates with the ink chamber. The pen body includes a number of electrically conductive traces that extend from a printer interface region to the print head. The print head may be surface mounted to the body, or connected with anisotropic or Z-axis conductive adhesive. The traces may be conductive material applied into grooves on the surface of the body, or an insert molded leadframe. The interface region and print head may be on a common surface of the body.

BRIEF DESCRIPTION OF THE DRAWINGS

FIG. 5 is an enlarged sectional view of a print head according to an alternative embodiment of the invention.

FIG. 6 is a perspective view of an ink jet pen according to an alternative embodiment of the invention.

DETAILED DESCRIPTION OF A PREFERRED EMBODIMENT

Figure 1:
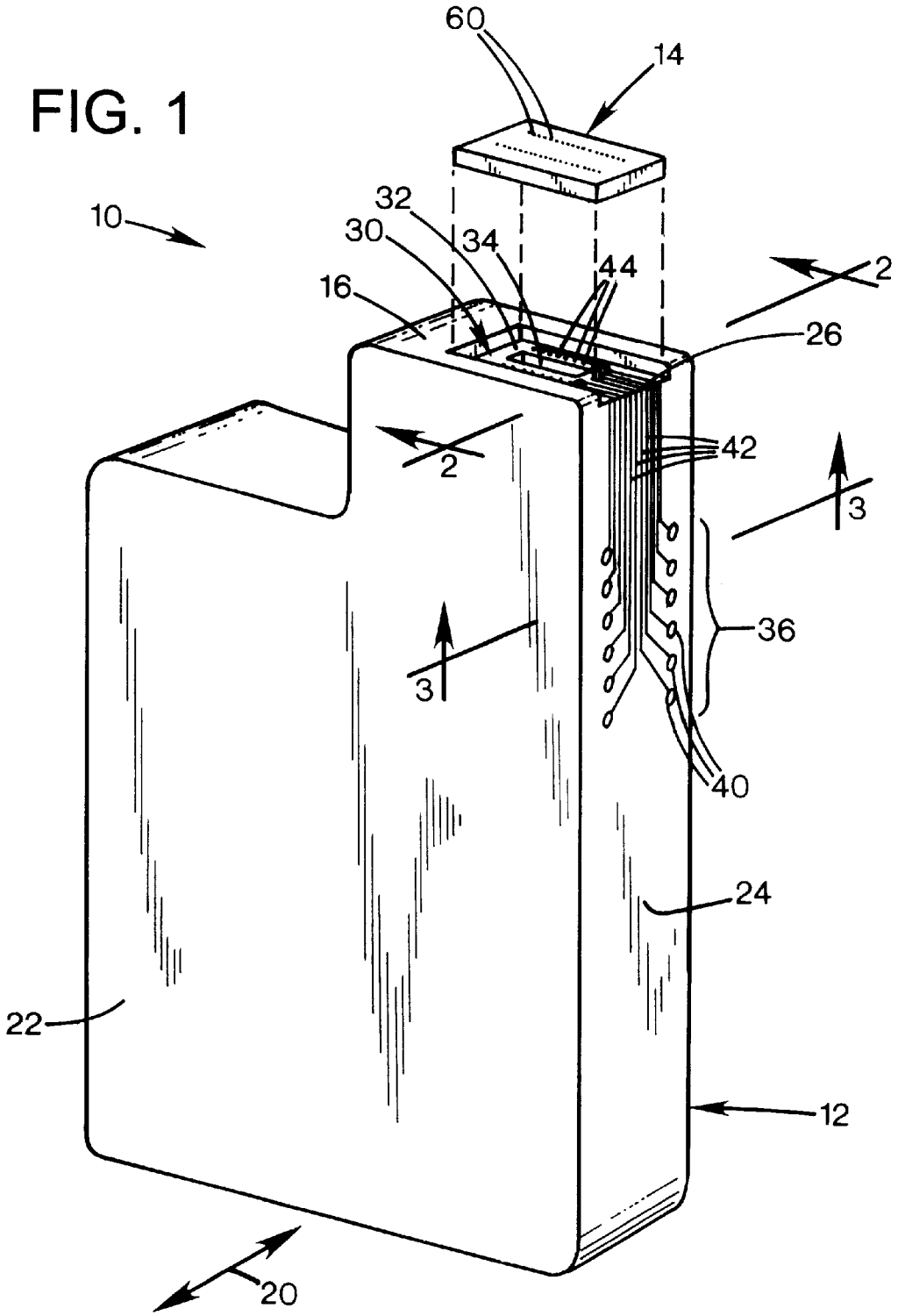
FIG. 1 is a perspective view of an ink jet pen according to a preferred embodiment of the invention.

FIG. 1 shows an ink jet pen 10 including a pen body 12 and an attached print head 14. The body defines an ink chamber (not shown). A nose surface 16 of the pen defines a media plane that is parallel and adjacent to a media path during printing of a media sheet by the pen. The pen is illustrated for clarity in a nose-up orientation, although in normal operation the pen is operated nose-down just above the media path, and is carried by a pen carriage of an ink jet printer to reciprocate along a scan axis 20 parallel to the nose surface, and perpendicular to major side walls 22 of the pen.

The pen has an interconnect surface 24 that is perpendicular to and adjoins the nose surface 16 at a nose edge 26. A print head recess 30 is defined in the pen at the nose surface, and has a width and depth to closely receive the print head, so that the upper surface of the print head is flush with the surface when installed, as will be discussed in detail below. The recess has a floor surface 32 that extends flat to the nose edge 26, and which defines a central ink passage 34 that communicates with the ink chamber of the pen.

The recess floor 32 and interconnect surface 24 include electrical conductors that are integral with the pen body to carry electrical signals between a connector region 36 on the interconnect surface, and the print head 14. The connector region includes an array of lands or contacts 40 that are positioned to contact probes or other electrical contacts on a printer carriage when the pen is installed for use, so that control signals may be transmitted from the printer or other control circuitry to the pen. A conductive trace 42 extends from each of the lands 40, along the interconnect surface, articulating about the edge 26, and along the recess floor 32 of the nose surface. Each trace connects to a respective small contact pad 44 on the recess floor. These contact pads are arrayed about the ink aperture 34 away from the side walls of the recess, and in locations corresponding to conductive contacts on the rear of the print head.

Figure 2:
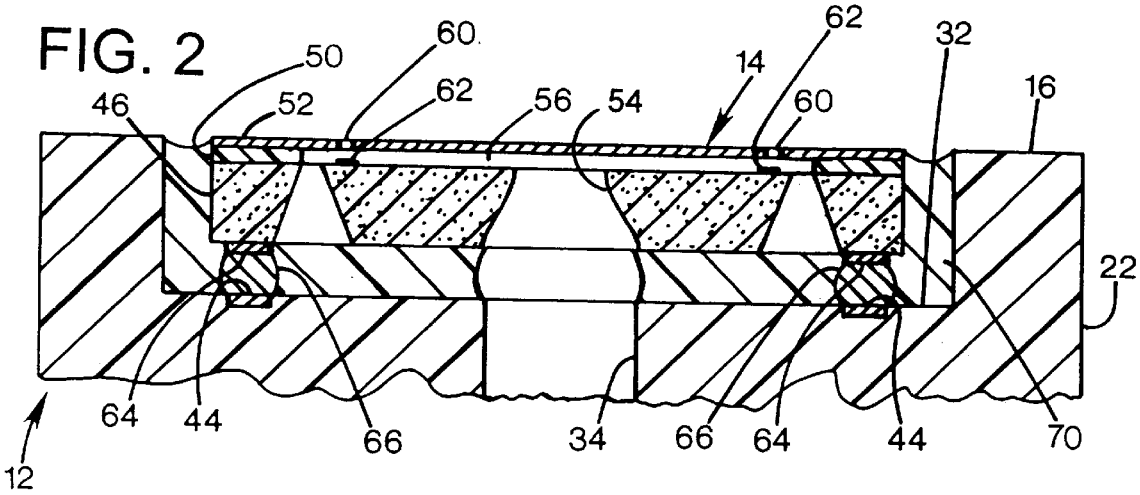
FIG. 2 is an enlarged sectional view of the embodiment of FIG. 1 taken along line 2—2.

As shown in FIG. 2, the print head 14 includes a silicon substrate 46 on top of which is a barrier layer 50, to which is secured an orifice plate 52. The substrate defines an ink via 54 that is registered with the pen body's ink aperture 34, and which communicates with an ink manifold 56 between the upper surface of the substrate and the lower surface of the orifice plate, and which is laterally contained by the barrier layer. The orifice plate defines arrays of orifices 60, each of which is registered with a firing resistor 62 on the substrate upper surface. The orifices are arrayed in lines perpendicular to the plane of the drawing, and which are perpendicular to the scan axis so that a swath of ink droplets may be ejected as the firing resistors are activated when ink is in the manifold 56.

The rear surface of the print head includes conductive rear contacts 64, which are arrayed to register with the pads 44 on the pen body. An electrical connection is provided between the print head and the pen body by solder connections 66. These are formed by preexisting solder bumps on the rear of the print head, which are melted in a solder reflow process that provides a suitable electrical connection. The solder is provided in controlled amounts so that there is no shorting between adjacent connections. The print head floats while the solder is melted, and the surface tension of the fluid solder serves to align the print head precisely to the metal pattern the pen body.

To ensure a fluid seal about the ink aperture 34 and ink via 54, preventing ink leakage, the gap between the print head and the pen body recess is filled with an encapsulant material 70. The wicking properties of the encapsulant and the small gap between the print head and the pen body cause it to fill the entire gap, but to remain clear of the ink aperture. Encapsulant fill is limited, to ensure that it remains at or below flush with the nose surface 16; a positive meniscus would require additional clearance with a media sheet, causing attendant disadvantages discussed above. The flush configuration avoids damage to or by a wiper that wipes across the print head during routine servicing and operation to remove contaminants by eliminating steps or sharp edges. The flush configuration also avoids puddles that may develop in unfilled recesses, which may affect and misdirect droplets fired from adjacent orifices. The encapsulant also provides the advantage of a strong mechanical bond, which withstands thermal stresses caused by the differences in coefficients of thermal expansion between the print head and the substrate. Thus, the encapsulant will bear these stresses, instead of the more fragile solder connections. In a preferred embodiment, the encapsulant is a filled polymer such as silica-filled epoxy.

Figure 3:
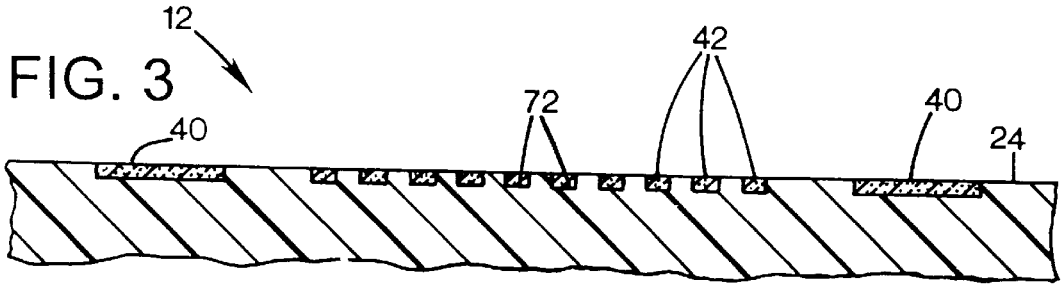
FIG. 3 is an enlarged sectional view of the embodiment of FIG. 1 taken along line 3—3.

FIG. 3 shows the how the conductive traces 42 and lands 40 are formed integrally with the pen body 24 in the preferred embodiment. The pen body is molded plastic, formed with grooves or channels 72 in the pattern of the desired traces. The channels are filled in flush with a conductive material such as silver-filled epoxy. This may be applied to the surface and the excess scraped away to leave only the channels filled. In the preferred embodiment, traces have a width of 0.010–0.015inches and a spacing of 0.025–0.030 inches, with a depth of 0.010–0.015 being preferred. A protective cover layer is subsequently applied to protect the traces, while leaving the pads exposed.

The illustrated pen has significant advantages over pens with separate conductive circuit elements to connect between the printer and the print head. These elements, such as the flexible TAB circuit discussed above, require many extra manufacturing steps to connect to the pen body. In addition, this method of assembly allows forward compatibility, so that print heads may become more advanced, yet still use the same standard attachment layout on the pen body. This also allows standard pen bodies to be used with different print heads for different products. Also, different pen bodies needed for compatibility with different printers in different markets may utilize the same print heads, allowing manufacturing economies of scale.

In alternative embodiments, the conductive paste may be applied selectively to a flat surface, such as by a silk screen, or by an automated syringe dispensing a controlled bead. In further alternative embodiments, the traces may be a lead frame preformed from metal sheet, and molded into the pen body surface by an insert molding process. In each embodiment, one set of exposed pads is provided for connection to the printer at the carriage, and another set is provided for direct connection of the print head.

Figure 4:
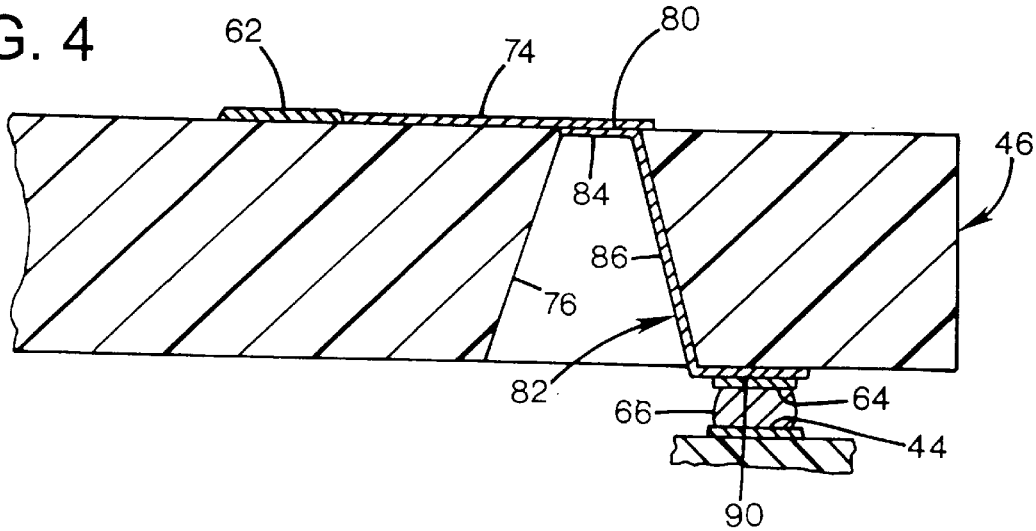
FIG. 4 is an enlarged sectional view of a print head according to the embodiment of Figure.

FIG. 4 shows how an electrical connection is provided from the rear of the print head substrate 46 to the front surface. A front metallization layer 74 is applied to the front surface. Then, a back channel 76 is etched into the rear surface to reach the rear of the metallization 74 at a via location 80 (the back channel appearing similar to the ink via 54, but in fact being separate and distinct.) The walls of the back channel are offset by 74.7° from the horizontal. The etchant is selected to attack the silicon substrate but to leave intact the metallization 74. Then, a back metallization trace 82 is applied with one end 84 overlaying the rear of the front metallization 74, an intermediate portion 86 extending down the sidewall of the back channel, and a lower portion 90 extending from the back channel along the rear surface of the substrate. The rear contact 64 is applied to the end of the lower portion 90, or an exposed portion of the lower portion 90 may serve as the contact. Passivation is applied to protect areas not needed to be exposed for electrical contact. While shown as connecting a resistor 62 directly to a dedicated contact 64, the traces may connect the rear contacts to other circuitry on the print head such as multiplexing circuitry that in turn controls the firing of the resistors. The solder bumps may be applied to the print head when the substrate is in wafer form, by solder jet application, or stenciling and reflowing a solder paste to the wafer.

FIG. 5 show an alternative means of electrically connecting the print head to the pen. Instead of solder bumps and a reflow process, anisotropic conductive adhesive 92 is applied over the pads 44 on the pen body recess. Such adhesives have the property of conducting electricity in only one direction. They are also known as "Z-axis" adhesives, and in this case conduct electricity only in a direction perpendicular to the plane of the print head. Thus, conduction is provided between the pen body and the print head, but no shorting occurs between adjacent pads. This permits the adhesive to be applied in larger swaths covering multiple pads 44, without shorting. Adhesive may be applied by pin transfer or tampo printing using pins or a rubber stamp to transfer ink to the pen body recess from an "inked" pad, or with a syringe to dispense a bead of adhesive in the desired locations. Alternatively, a die-cut coupon of anisotropic conductive film may be placed in the recess. This may be of a B-phase epoxy or other material that is easily processed and applied. The adhesive is then cured, which provides a conductive connection in the Z-axis only. Suitable materials are Z-axis adhesives available from Sholdahl, Inc. of Northfield, Minn. The adhered print head is then back-filled with encapsulant 70 as discussed above for fluid sealing and mechanical strength.

An alternative pen configuration 94 is shown in FIG. 6. In this embodiment, the print head 14 and the interconnect region 36 are positioned on a common planar surface 96. This allows the integral traces and lands 42, 40 to be applied on a single plane without articulating about edges or comers. Thus, simpler application processes such as screening may be used to apply the traces. Alternatively, simpler leadframe manufacturing and insert molding processes may be employed. An alignment guide 100 provides precise mechanical registration with a mating feature on the pen carriage.

In an alternative embodiment, the print head, shown herein as a "face shooter" ejecting droplets perpendicular to its major plane, may be provided by a "side shooter" that ejects droplets from an edge. In such an embodiment, the ejection direction may be in any of the three lateral directions away from the interconnect region, with the print head positioned immediately at the edge of the body. Such a configuration eliminates the need to provide spacing between the print head and the interconnect region that arises due to a paper path just above the print head, and a carriage connector just above the interconnect region. In the preferred embodiment, this may be addressed by providing a low profile connector on a paddle that extends from a direction away from the print head, and by curving the paper path up above the connector.

While the above is discussed in terms of preferred and alternative embodiments, the invention is not intended to be so limited. For instance, while the pen body is discussed as a plastic molded element, it may be formed of alternative material such as ceramic or glass, which are more suitable for permanent usage with separately replaceable ink supplies, instead of the disposable pen illustrated.

What is claimed is:

1. An ink jet pen comprising:

a pen body defining an ink chamber;

the pen body having an outer surface with and a recess for receiving a print head;

a print head integrated circuit chip within the recess connected to the pen body and in fluid communication with the ink chamber;

the print head chip having an orifice surface facing away from the pen body, and a rear surface adjacent the pen body;

the rear surface of the print head chip including a plurality of electrical contacts;

the pen body including a plurality of electrical lands registered with and electrically connected to the print head electrical contacts;

the print head orifice surface substantially coplanar with the pen body outer surface immediately adjacent to the recess.

2. The apparatus of claim 1 wherein the rear surface of the print head includes solder bumps.

3. The apparatus of claim 1 including a conductive adhesive connecting the print head contacts to the pen body electrical lands.

4. The apparatus of claim 3 wherein the adhesive is conductive only perpendicular to the plane of the print head, such that it does not short adjacent contacts and lands.

5. A method of manufacturing an ink jet pen comprising the steps;

forming a pen body having an outer surface with a recess for receiving a print head;

defining a plurality of elongated grooves on the pen body; at least partially filling the grooves with a plurality of electrically conductive traces;

providing a print head integrated circuit chip having a rear surface with a plurality of electrical contacts, and an orifice surface;

securing the print head in the recess such that the orifice surface is substantially coplanar with the pen body outer surface adjacent the recess; and connecting each of the print head contacts to a selected one of the conductive traces.

6. The method of claim 5 wherein forming a plurality of traces includes applying a conductive material onto an exterior surface of the body.

7. The method of claim 6 including applying the conductive material to only a single major surface of the body.

8. The method of claim 5 wherein the step of connecting includes soldering the print head to the pen body.

* * * * *